US010302345B2

(12) United States Patent
Lee et al.

(10) Patent No.: US 10,302,345 B2
(45) Date of Patent: May 28, 2019

(54) REFRIGERATOR

(71) Applicant: Samsung Electronics Co., Ltd., Suwon-si (KR)

(72) Inventors: Sun Gyou Lee, Gwangju (KR); Yong Seop Hyun, Gwangju (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 15/508,347

(22) PCT Filed: Jul. 24, 2015

(86) PCT No.: PCT/KR2015/007699
§ 371 (c)(1),
(2) Date: Mar. 2, 2017

(87) PCT Pub. No.: WO2016/036005
PCT Pub. Date: Mar. 10, 2016

(65) Prior Publication Data

US 2017/0284724 A1 Oct. 5, 2017

(30) Foreign Application Priority Data

Sep. 2, 2014 (KR) ..... 10-2014-0116251
Nov. 14, 2014 (KR) ..... 10-2014-0158766
Jan. 5, 2015 (KR) ..... 10-2015-0000552

(51) Int. Cl.
*F25B 5/02* (2006.01)
*F25B 39/02* (2006.01)
(Continued)

(52) U.S. Cl.
CPC ..... *F25D 17/065* (2013.01); *F25B 5/02* (2013.01); *F25D 11/022* (2013.01);
(Continued)

(58) Field of Classification Search
CPC .... F25D 17/065; F25D 2321/00; F25D 21/04; F25D 23/02; F25D 23/08; F25D 23/04; F25D 23/066; F25D 17/067; F25D 17/08
See application file for complete search history.

(56) References Cited

U.S. PATENT DOCUMENTS 2,909,910 A 10/1959 Saunders
2,975,619 A 3/1961 Saunders
(Continued)

FOREIGN PATENT DOCUMENTS

CN 103363753 10/2013
CN 103528304 1/2014
(Continued)

OTHER PUBLICATIONS

International Search Report dated Oct. 13, 2015 of the corresponding International Application No. PCT/KR2015/007699.
(Continued)

*Primary Examiner* — Cassey D Bauer
(74) *Attorney, Agent, or Firm* — Staas & Halsey LLP

(57) ABSTRACT

The present disclosure relates to a refrigerator with an improved structure capable of improving cooling efficiency. A refrigerator according to an embodiment of the present disclosure includes a main body; a storage room formed in the main body, wherein a front part of the storage room is opened; a door configured to open or close the opened front part of the storage room; an evaporator installed in a back part of the storage room; an evaporator cover configured to partition the storage room into a storage area and a cool air generating area in which the evaporator is disposed; a first flow path formed between the evaporator and a back surface of the storage room; and a second flow path formed between the evaporator and the evaporator cover.

20 Claims, 12 Drawing Sheets

(51) Int. Cl.

| | |
|---|---|
| ***F25D 11/00*** | (2006.01) |
| ***F25D 11/02*** | (2006.01) |
| ***F25D 17/06*** | (2006.01) |

(52) U.S. Cl.

CPC ..... *F25D 17/062* (2013.01); *F25B 39/024* (2013.01); *F25B 2341/0662* (2013.01); *F25B 2400/0409* (2013.01); *F25B 2400/0411* (2013.01); *F25D 11/00* (2013.01); *F25D 2317/067* (2013.01); *F25D 2317/0651* (2013.01); *F25D 2317/0665* (2013.01)

(56) References Cited

U.S. PATENT DOCUMENTS

| | | | | |
|---|---|---|---|---|
| 3,009,338 | A | 11/1961 | Dobbie | |
| 3,026,688 | A | 3/1962 | O'Connell | |
| 3,075,366 | A | 1/1963 | Jung | |
| 3,103,797 | A | 9/1963 | Harley, Jr. | |
| 5,819,552 | A * | 10/1998 | Lee | F25D 17/065 62/407 |
| 5,911,750 | A | 6/1999 | Mandel et al. | |
| 6,058,734 | A | 5/2000 | Lee | |
| 6,293,122 | B1 | 9/2001 | Chang | |
| 2007/0006604 | A1 | 1/2007 | Behr | |
| 2013/0264929 | A1 * | 10/2013 | An | F25D 17/00 312/404 |

FOREIGN PATENT DOCUMENTS

| | | | |
|---|---|---|---|
| EP | 1586837 | * 10/2005 | F25D 17/06 |
| EP | 1821051 | 8/2007 | |
| EP | 1821051 | * 10/2008 | F25C 1/24 |
| KR | 10-2003-0035863 | 12/2004 | |
| KR | 10-2004-0105029 | 12/2004 | |

OTHER PUBLICATIONS

Written Opinion dated Oct. 12, 2015 of the corresponding International Application No. PCT/KR2015/007699.

Extended European Search Report dated Feb. 21, 2018, in corresponding European Patent Application No. 15838763.9, 7 pgs.

Chinese Office Action dated Oct. 26, 2018 in Chinese Patent Application No. 201580047116.3.

* cited by examiner

[Fig. 1]
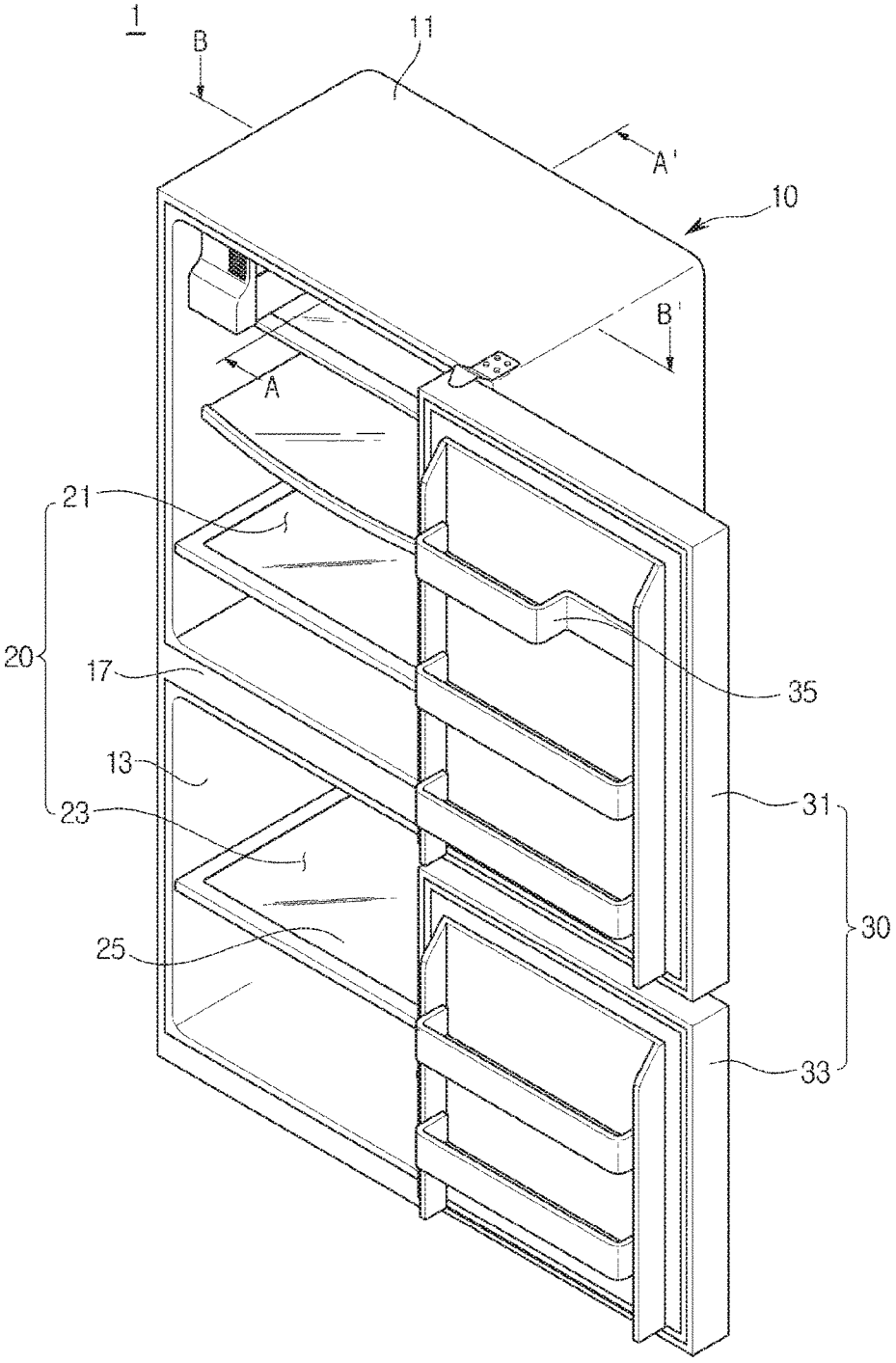

[Fig. 2]
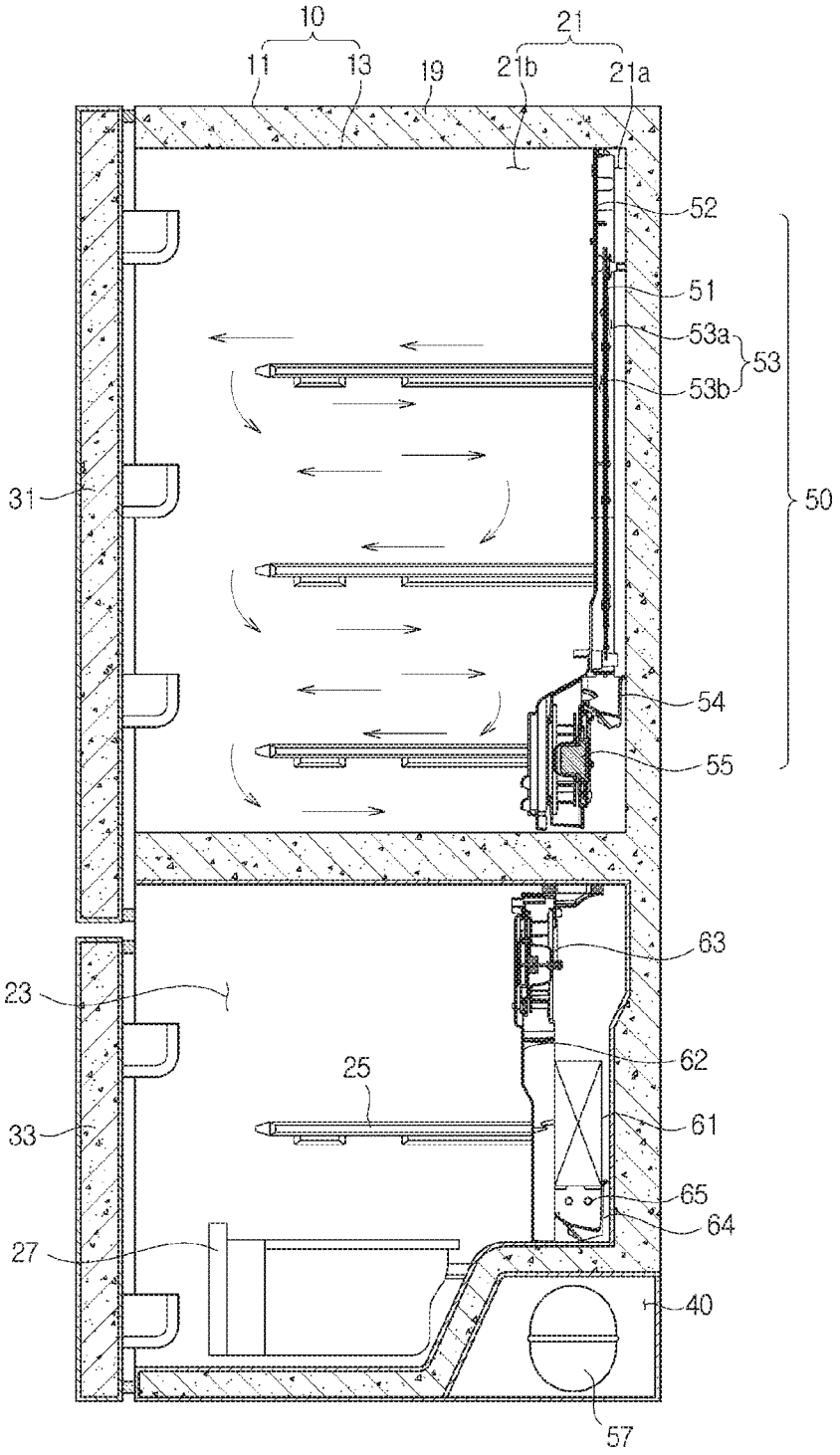

[Fig. 3]
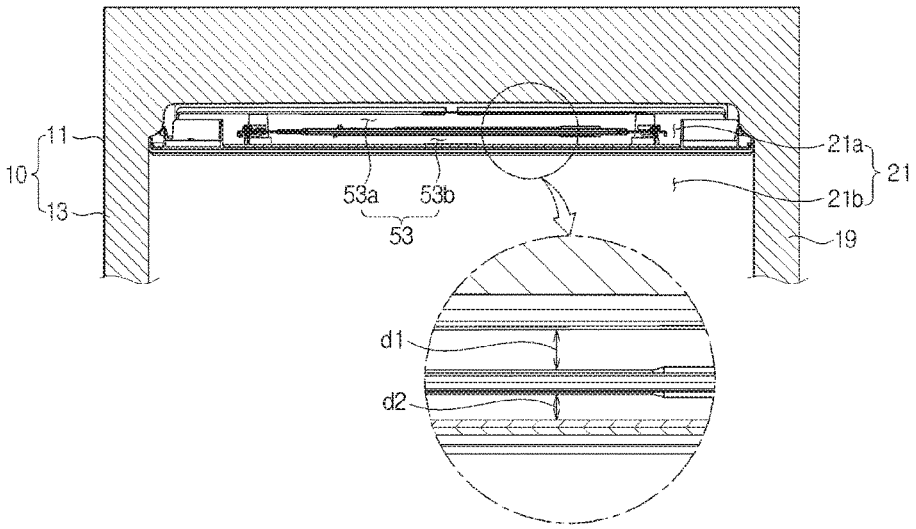
[Fig. 4]
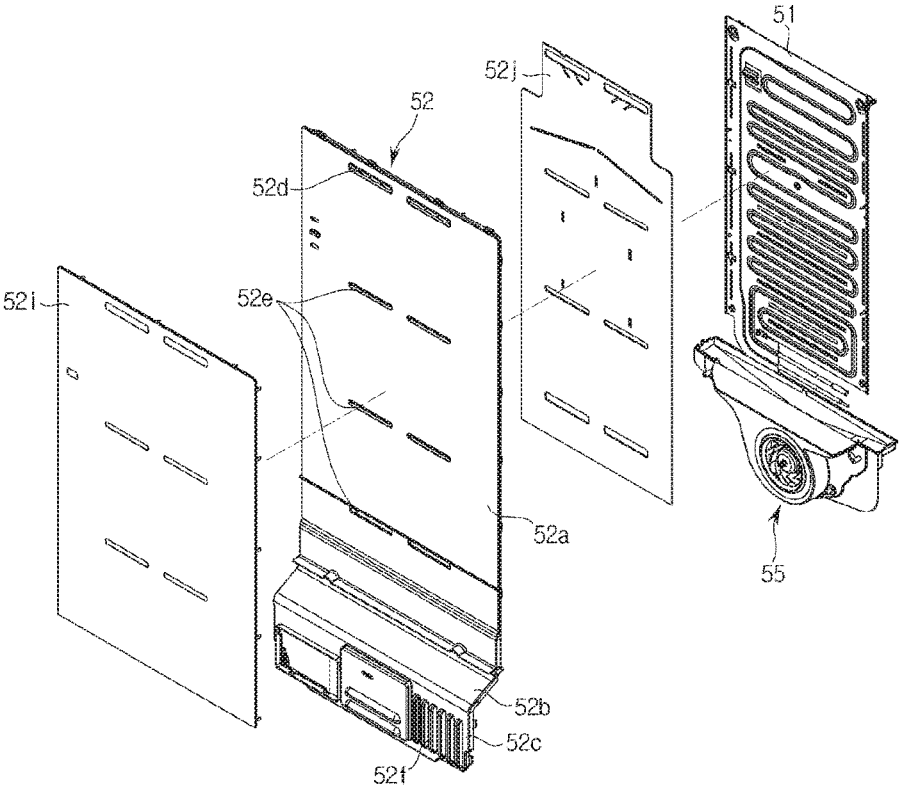

[Fig. 5]
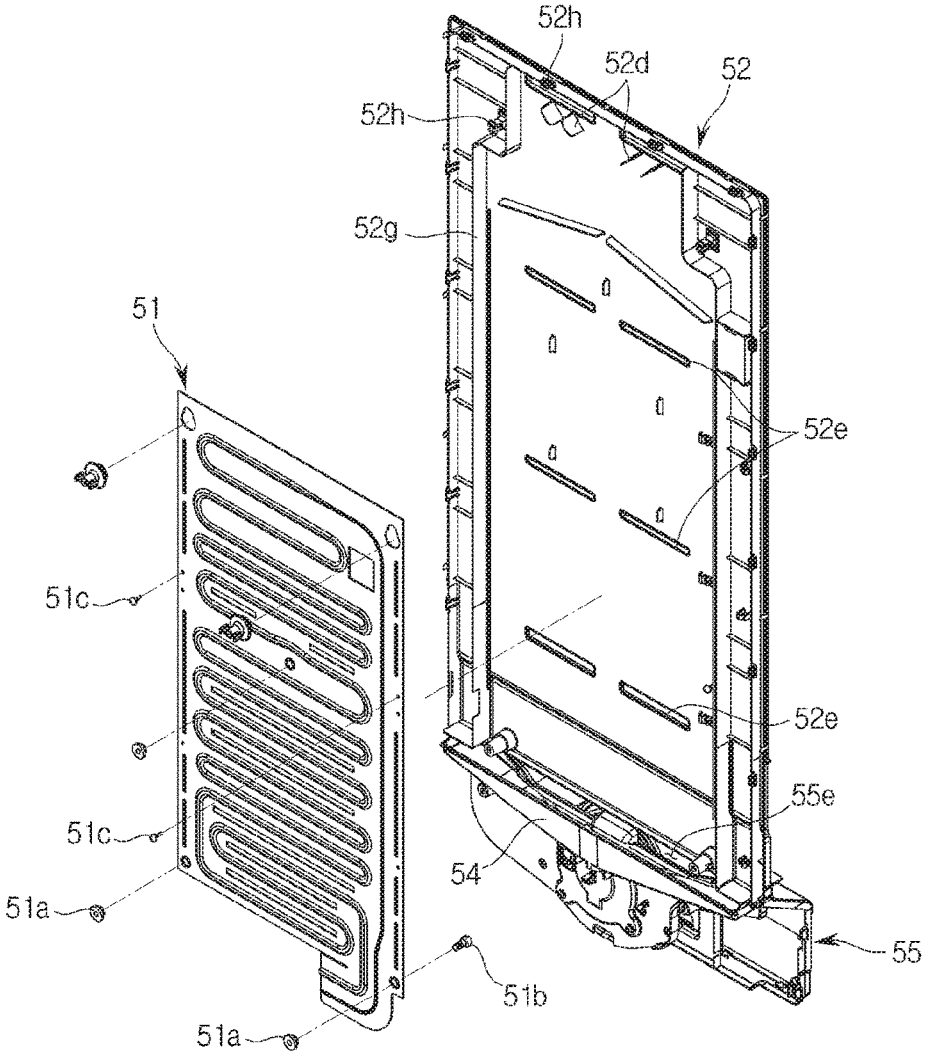

[Fig. 6]
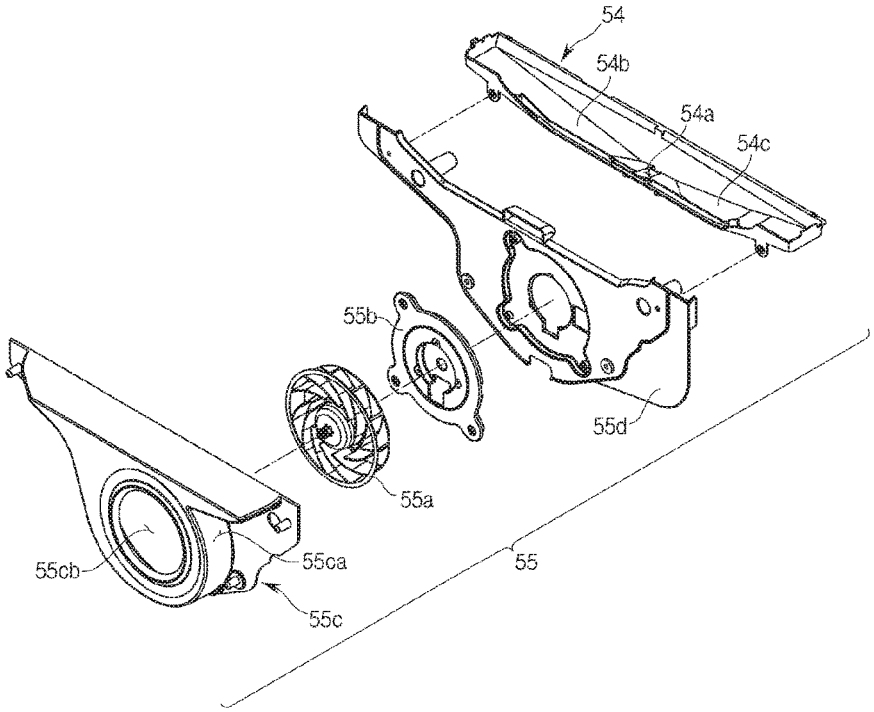
[Fig. 7]
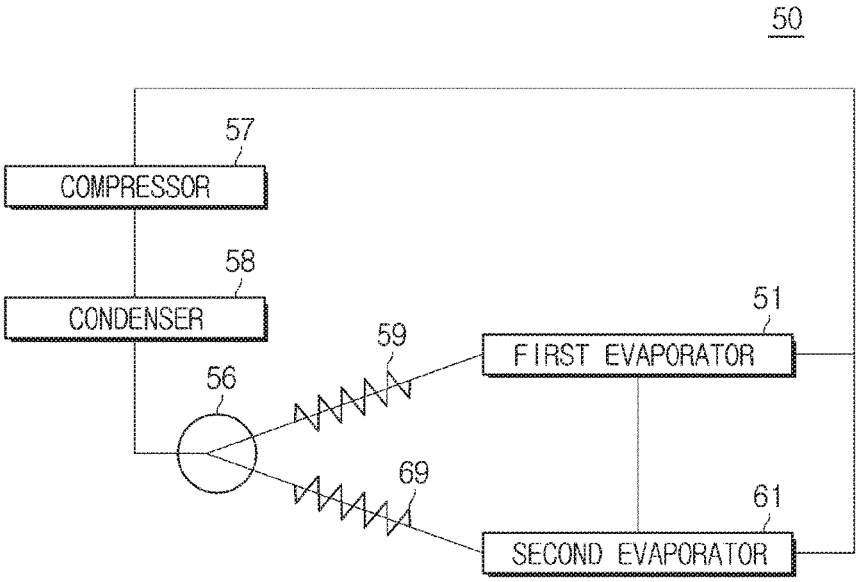

[Fig. 8]
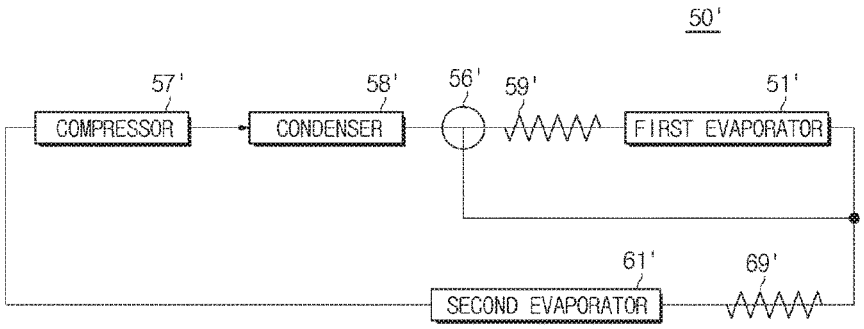

[Fig. 9]
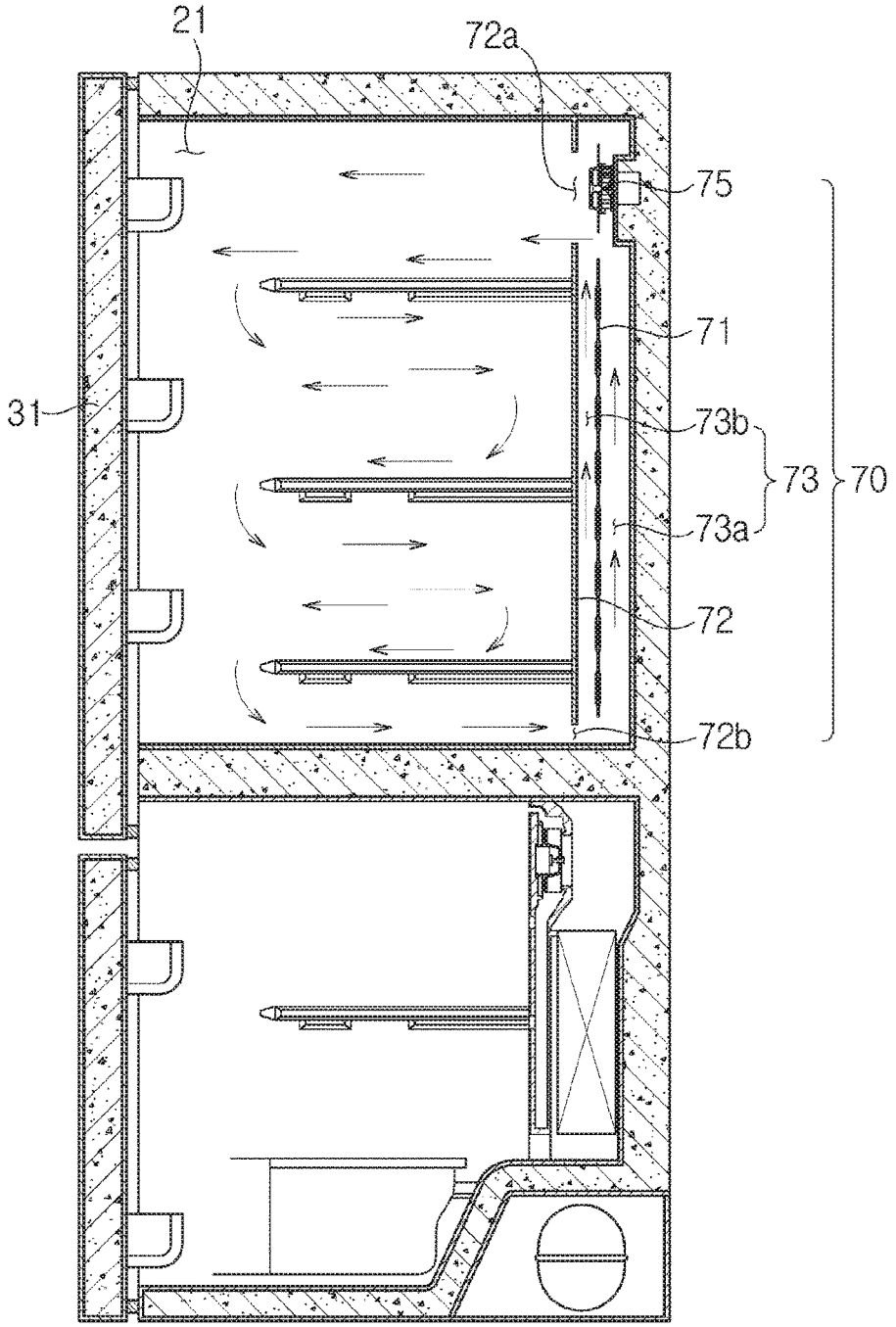

[Fig. 10]
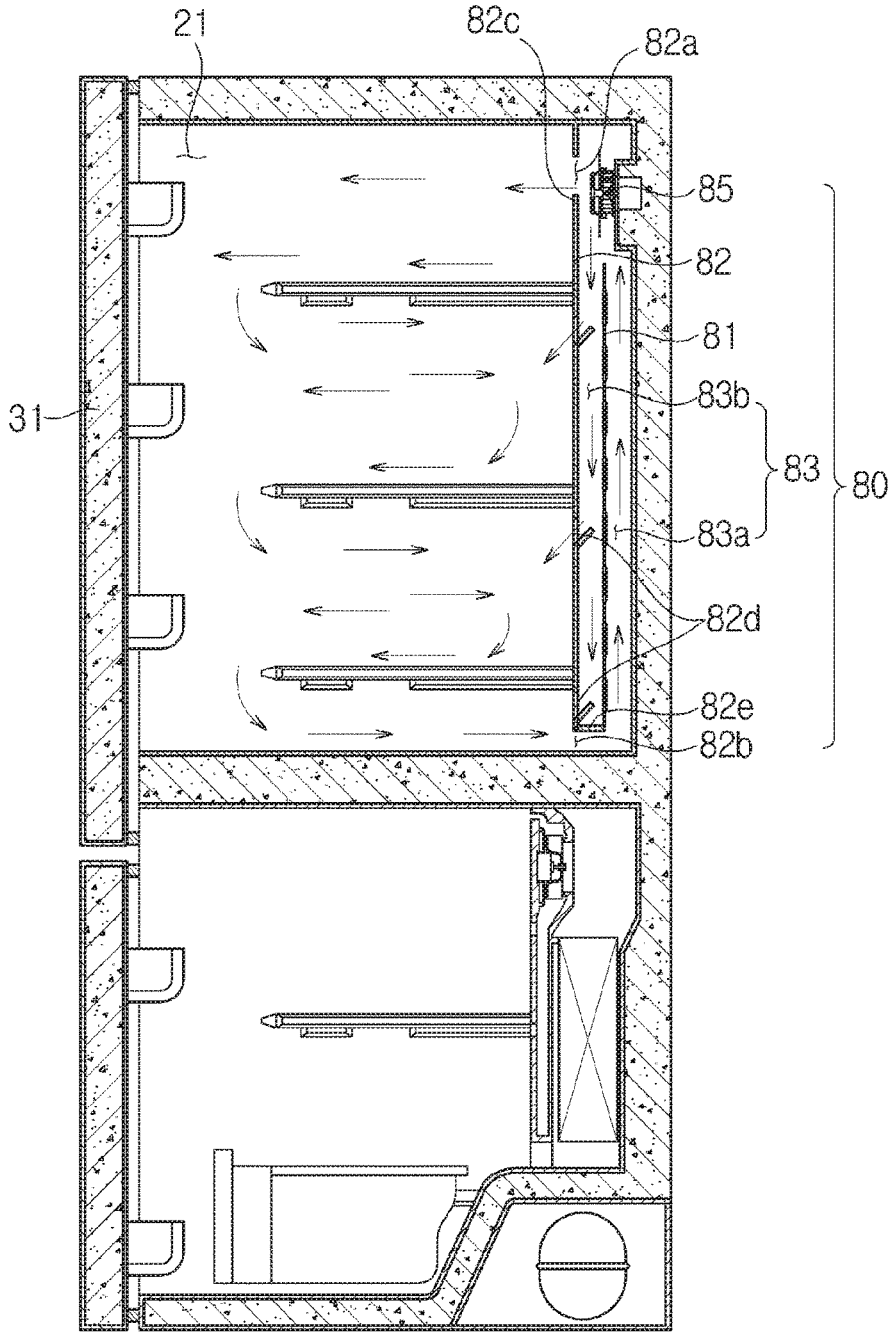

[Fig. 11]
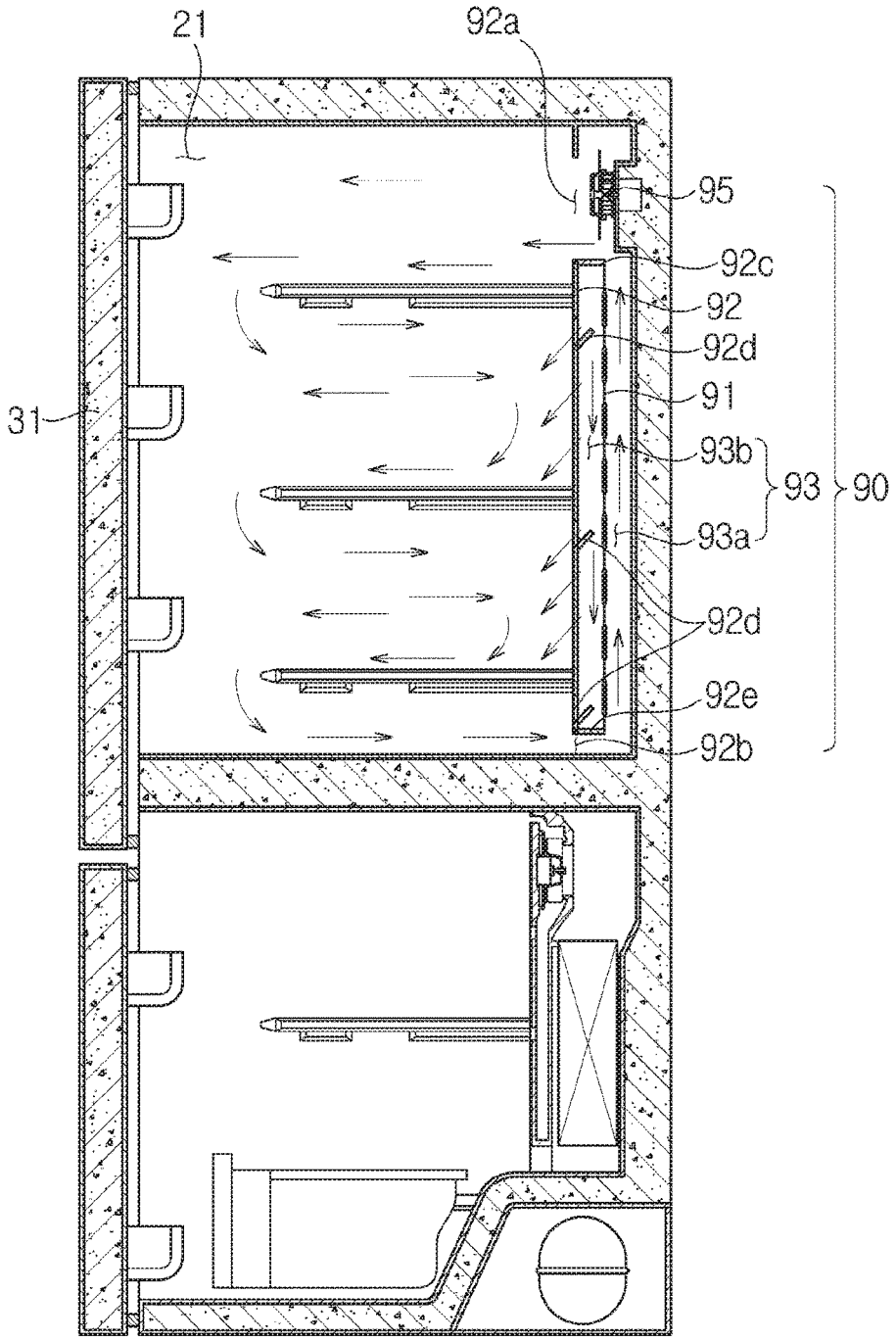

[Fig. 12]
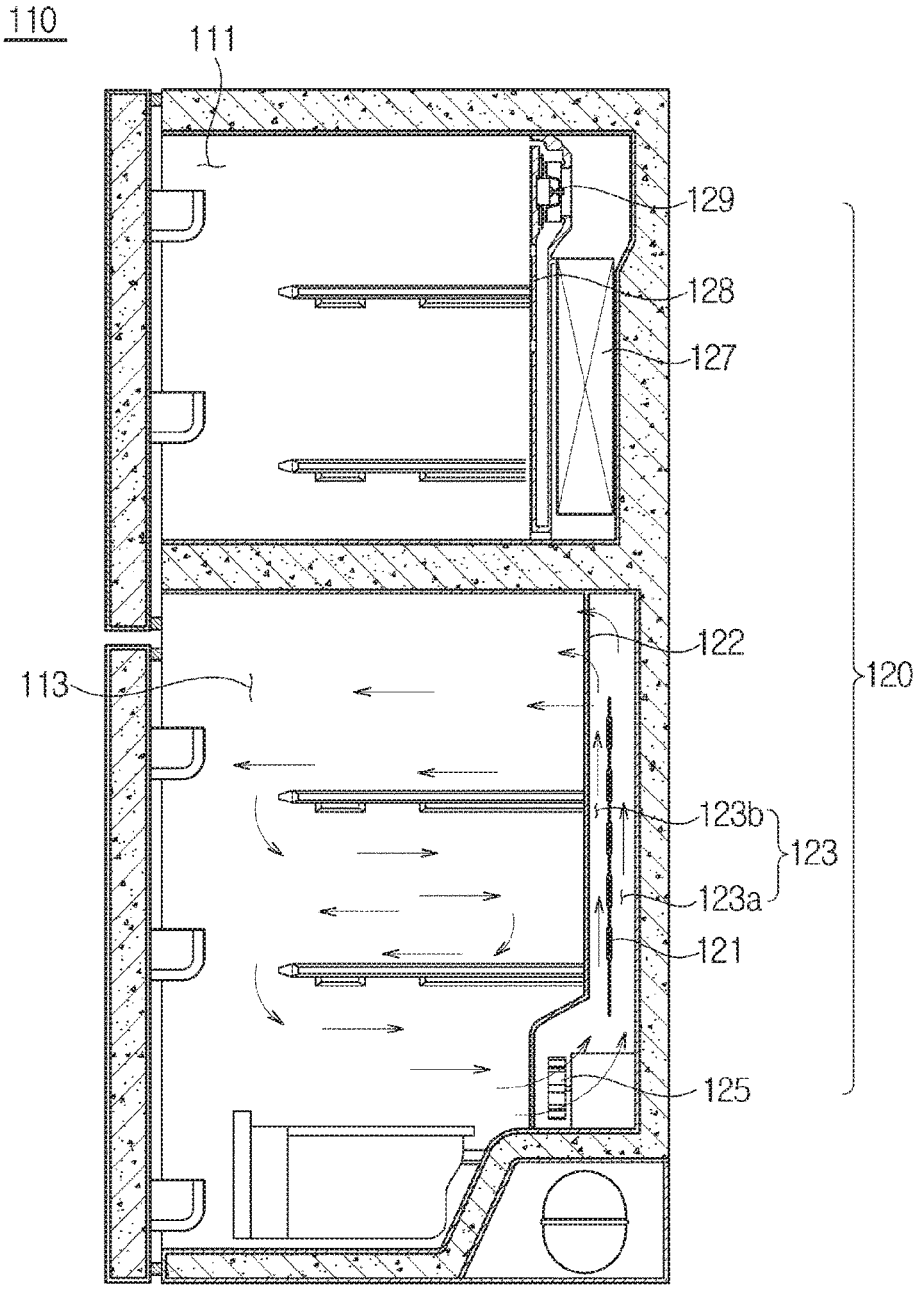

[Fig. 13]
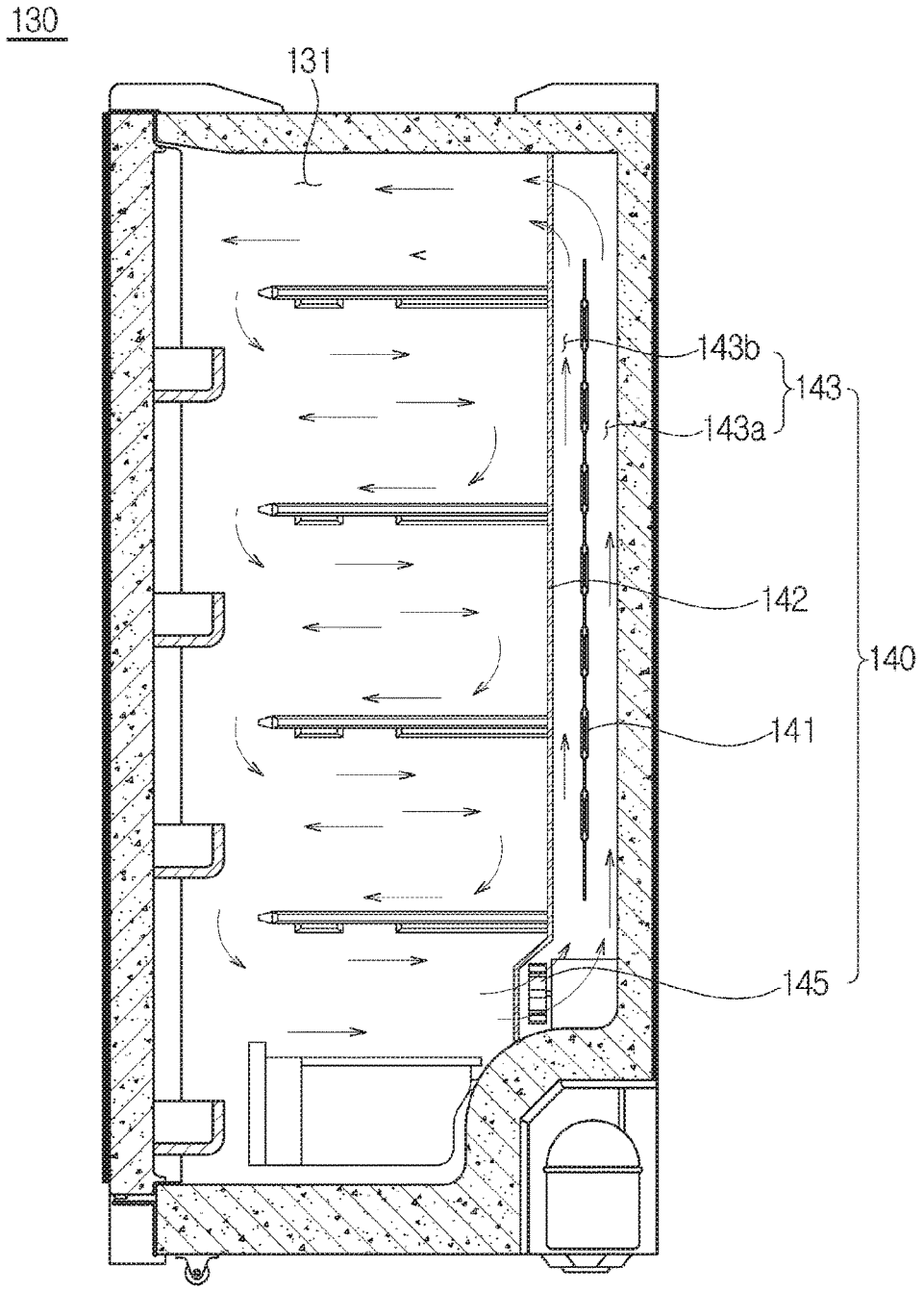

[Fig. 14]
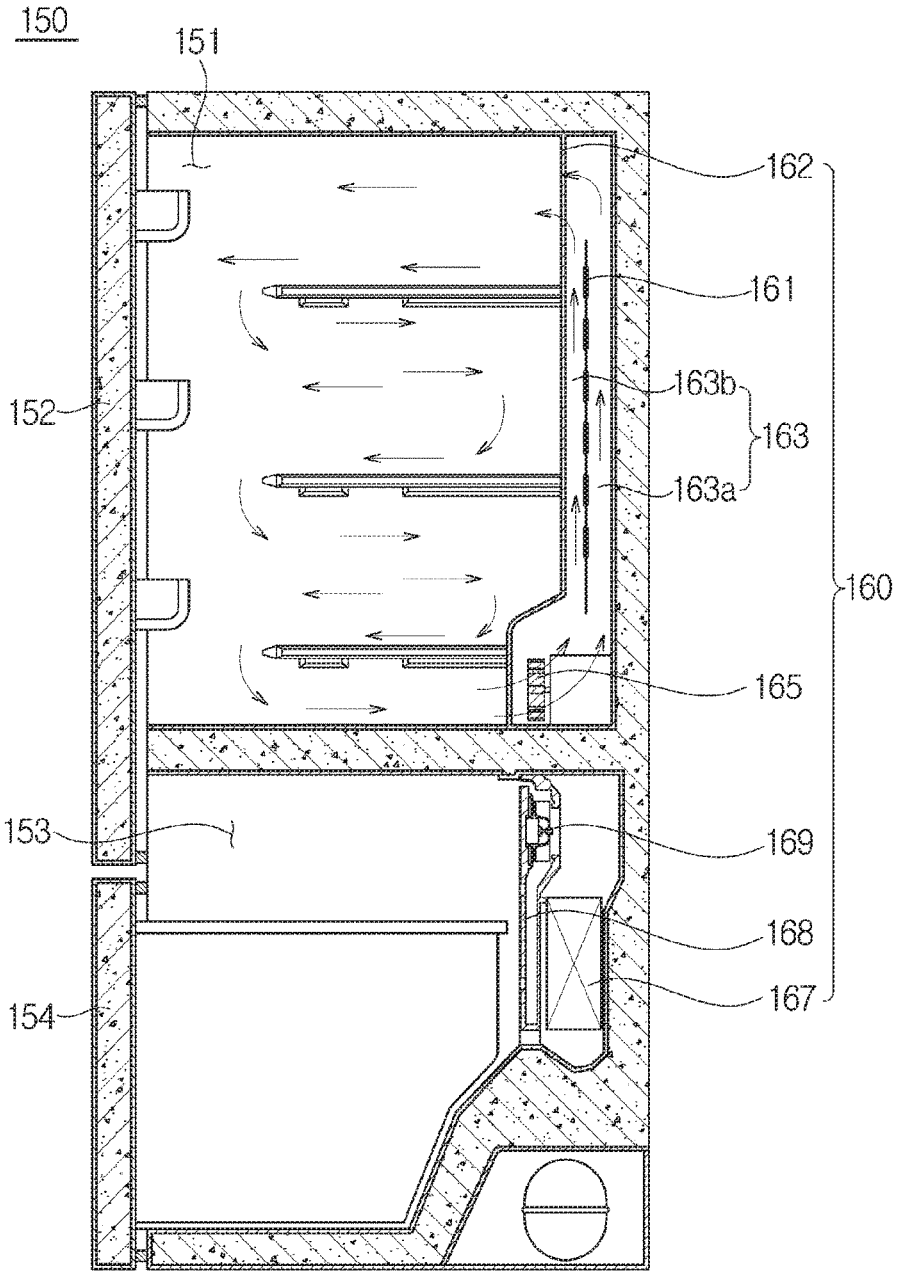

REFRIGERATOR

CROSS-REFERENCE TO RELATED APPLICATIONS

This application claims the benefit under 35 U.S.C. Section 371, of PCT International Application No. PCT/KR2015/007699, filed Jul. 24, 2015, which claimed priority to Korean Application Nos. 10-2014-0116251, filed Sep. 2, 2014, 10-2014-0158766, filed Nov. 14, 2014 and 10-2015-0000552 filed Jan. 5, 2015 in the Korean Intellectual Property Office, the disclosures of which are hereby incorporated by reference.

TECHNICAL FIELD

The present disclosure relates to a refrigerator with an improved structure capable of improving cooling efficiency.

BACKGROUND ART

In general, a refrigerator is used to maintain the freshness of various food for a long duration by supplying cool air generated by an evaporator to a storage room. The storage room of the refrigerator is partitioned into a refrigerating compartment that is maintained at about 3° C. to keep food refrigerated, and a freezing compartment that is maintained at about −20° C. to keep food frozen.

The freezing compartment stores food (for example, meat, fish, and frozen dessert) that needs to be maintained under a freezing temperature, and the refrigerating compartment stores food (for example, vegetables, fruits, and drinks) that needs to be maintained above a freezing temperature.

The refrigerator is driven in a cooling cycle in which refrigerant is successively compressed, condensed, expanded, and evaporated through a compressor, a condenser, an expander, and an evaporator, respectively. According to the kinds of refrigerators, a single evaporator placed in a freezing compartment cools both the freezing compartment and a refrigerating compartment, or evaporators are respectively placed in a freezing compartment and a refrigerating compartment to cool the freezing compartment and the refrigerating compartment independently.

In the evaporator, refrigerant in a liquid state is evaporated to take away evaporation heat from surrounding air to thereby cool the surrounding air. Evaporators are classified into a direct cooling type evaporator and an indirect cooling type evaporator. The direct cooling type evaporator has low consumption power and excellent cooling performance since it performs heat exchange directly inside a storage room. In contrast, in the indirect cooling type evaporator, cool air cooled in space spaced from a storage room moves to the storage room by a fan. The indirect cooling type evaporator has excellent heat exchange efficiency and can reduce the generation of frost around the evaporator since it can be entirely used. Comparing the indirect cooling type evaporator to the direct cooling type evaporator, the indirect cooling type evaporator requires a fan to circulate cool air into the storage room, and a defrosting heater to process defrost water that is generated from the evaporator and an evaporator cover.

DISCLOSURE

Technical Problem

An aspect of the present disclosure is to provide a refrigerator with an improved structure capable of improving the heat exchange efficiency of an evaporator.

Another aspect of the present disclosure is to provide a refrigerator with an improved structure having advantages of a direct cooling type evaporator and an indirect cooling type evaporator.

Technical Solution

In accordance with an aspect of the present disclosure, there is provided a refrigerator including: a main body; a storage room formed in the main body, wherein a front part of the storage room is opened; a door configured to open or close the opened front part of the storage room; an evaporator installed in a back part of the storage room; an evaporator cover configured to partition the storage room into a storage area and a cool air generating area in which the evaporator is disposed; a first flow path formed between the evaporator and a back surface of the storage room; and a second flow path formed between the evaporator and the evaporator cover.

The refrigerator may further include a blow fan configured to blow cool air generated from the evaporator and to circulate the cool air in the storage room.

The evaporator cover may include an inlet part formed in a lower part of the evaporator cover, and configured to make air flow into the cool air generating area.

The blow fan may face the inlet part in the cool air generating area.

The inlet part may be formed at a location that is lower than a lower end of the evaporator, in the evaporator cover.

The blow fan may be installed below the evaporator to blow air upward through the first flow path and the second flow path in the cool air generating area.

The evaporator cover may further include a first outlet part formed in a upper part of the evaporator cover, and configured to move cool air to the storage room.

The first outlet part may be formed at a location that is higher than an upper end of the evaporator, in the evaporator cover.

A part of a lower part of the evaporator cover may be bent forward to form space in which the blow fan is installed in the cool air generating area.

The evaporator cover may further include a second outlet part formed between the first outlet part and the inlet part.

The blow fan may face a first outlet part formed in a upper part of the evaporator cover, in the cool air generating area.

In accordance with another aspect of the present disclosure, there is provided a refrigerator including: a main body; a storage room formed in the main body, wherein a front part of the storage room is opened; a door configured to open or close the opened front part of the storage room; an evaporator spaced forward from a back surface of the storage room; an evaporator cover spaced forward from the evaporator; and a blow fan configured to blow cool air generated from front and rear parts of the evaporator, and to move the cool air upward.

The evaporator cover may include an inlet part formed in a lower part of the evaporator cover, and an outlet part formed in a upper part of the evaporator cover, and the evaporator cover may be configured to partition the storage room into a storage area and a cool air generating area in which the evaporator is installed.

The blow fan may face the inlet part in the cool air generating area.

The inlet part may be formed at a location that is lower than a lower end of the evaporator, in the evaporator cover.

The outlet part may include a first outlet part formed at a location that is higher than an upper end of the evaporator.

The outlet part may further include a second outlet part formed between the first outlet part and the inlet part.

In accordance with still another aspect of the present disclosure, there is provided a refrigerator including: a main body; a storage room formed in the main body, wherein a front part of the storage room is opened; a door configured to open or close the opened front part of the storage room; an evaporator spaced forward from a back surface of the storage room; an evaporator cover spaced forward from the evaporator; a flow path through which cool air generated from front and rear parts of the evaporator passes; and a blow fan configured to blow the cool air and to move the cool air upward through the flow path.

The flow path may include: a first flow path formed between the evaporator and a back surface of the storage room; and a second flow path formed between the evaporator and the evaporator cover.

The evaporator cover may include an inlet part formed below the evaporator, and the blow fan may face the inlet part behind the evaporator cover.

The evaporator cover may further include an outlet part formed above the evaporator.

Advantageous Effects

The present disclosure has the following effects.

According to the technical ideas of the present disclosure, it is possible to improve the cooling efficiency of a refrigerator.

More specifically, by providing an evaporator having advantages of a direct cooling type evaporator and an indirect cooling type evaporator, it is possible to improve heat exchange efficiency, and to improve cooling efficiency due to efficient use of the entire evaporator.

BRIEF DESCRIPTION OF THE DRAWINGS

FIG. 1 is a perspective view showing an external appearance of a refrigerator according to an embodiment of the present disclosure;

FIG. 2 is a cross-sectional view of the refrigerator including a cool air generator according to an embodiment of the present disclosure, cut along a line A-A' of FIG. 1;

FIG. 3 is a cross-sectional view showing a cool air generator installed in a first storage room, cut along a line B-B' of FIG. 1;

FIG. 4 is an exploded perspective view showing a coupling relationship between an evaporator, an evaporator cover, a blow fan unit, and a defrost water collecting member, which are installed inside a first storage room, in the cool air generator of FIG. 2;

FIG. 5 is an exploded perspective view showing the evaporator, the evaporator cover, the blow fan unit, and the defrost water collecting member of FIG. 4, when seen from behind;

FIG. 6 is an exploded perspective view showing a coupling relationship between the blow fan unit and the defrost water collecting member of FIG. 4;

FIG. 7 is a block diagram for describing a cooling cycle of a cool air generator, according to an embodiment of the present disclosure;

FIG. 8 is a block diagram for describing a cooling cycle of a cool air generator, according to another embodiment of the present disclosure;

FIG. 9 is a cross-sectional view briefly showing a configuration of a refrigerator including a modified example of the cool air generator of FIG. 2;

FIG. 10 is a cross-sectional view briefly showing a configuration of a refrigerator including another embodiment of the cool air generator of FIG. 2;

FIG. 11 is a cross-sectional view briefly showing a configuration of a refrigerator including a modified example of the cool air generator of FIG. 10; and FIGS. 12 to 14 briefly show configurations of refrigerators which are different from the refrigerator of FIG. 2 and to which a cool air generator according to an embodiment of the present disclosure is applied.

BEST MODE

Hereinafter, embodiments of the present disclosure will be described in detail with reference to the accompanying drawings.

FIG. 1 is a perspective view showing an external appearance of a refrigerator according to an embodiment of the present disclosure, and FIG. 2 is a cross-sectional view of the refrigerator including a cool air generator according to an embodiment of the present disclosure, cut along a line A-A' of FIG. 1.

Referring to FIGS. 1 and 2, a refrigerator 1 may include a main body 10, a storage room 20, and a door 30.

The main body 10 may include an external body 11 and an internal body 13. The external body 11 may form an external appearance of the main body 10. The external body 11 may be made of a metal material having excellent durability and a sense of beauty.

The internal body 13 may be located in the inside of the external body 11. The internal body 13 may form an external appearance of the storage room 20. The internal body 13 may be made of a plastic material, and injection-molded into one body. Between the internal body 13 and the external body 11, an insulator 19 may be foamed to prevent cool air from escaping from the storage room 20.

The storage room 20 may have an opened front part to allow a user to put/take food in/out. According to an example, the storage room 20 may be partitioned into a plurality of storage rooms by at least one partition wall 17.

The storage room 20 may include a first storage room 21 and a second storage room 23. The first storage room 21 and the second storage room 23 may be partitioned by the partition wall 17. As shown in FIG. 1, the first storage room 21 may be located above the partition wall 17, and the second storage room 23 may be located below the partition wall 17.

The storage room 20 may include a refrigerating compartment and a freezing compartment. According to the kinds of refrigerators, the first storage room 21 may be provided as a refrigerating compartment, and the second storage room 32 may be provided as a freezing compartment. The refrigerator 1 according to an embodiment of the present disclosure may be a Bottom Mounted Freezer (BMF) type refrigerator in which the first storage room 21 provided as a refrigerating compartment is located above the second storage room 23 provided as a freezing compartment. The freezing compartment may be maintained at about −20° C., and the refrigerating compartment may be maintained at about 3° C. The freezing compartment and the refrigerating compartment may be insulated by the partition wall 17.

The storage room 20 may include a plurality of shelves 25 therein. The shelves 25 may be provided to support food, etc. stored in the storage room 20. A plurality of shelves 35 may be provided in each of the first and second storage rooms 21 and 23. The shelves 25 may be detachably arranged inside the storage room 20.

As shown in FIG. 2, in the storage room 20, a storage container 27 may be disposed. The storage container 27 may be provided in the shape of a box. The storage container 27 may form closed space to store food therein.

The storage room 20 may be opened or closed by the door 30. The door 30 may be rotatably coupled with the main body 10 to open or close the opened front part of the storage room 20. The first storage room 21 and the second storage room 23 may be opened and closed by a first door 31 and a second door 33 rotatably coupled with the main body 10.

In the rear part of the door 30, a door guide 35 in which food, etc. can be accommodated may be provided. There may be provided a plurality of door guides 35.

The refrigerator 1 may further include a machine room 40. The machine room 40 may be disposed in the lower part of the main body 10. More specifically, the machine room 40 may be disposed in the back part of the main body 10, and provide space in which some components of a cool air generator 50 are installed.

Hereinafter, the cool air generator 50 according to an embodiment of the present disclosure will be described in detail.

FIG. 3 is a cross-sectional view showing the cool air generator 50 installed in the first storage room 21, cut along a line B-B' of FIG. 1, FIG. 4 is an exploded perspective view showing a coupling relationship between an evaporator, an evaporator cover, a blow fan unit, and a defrost water collecting member, which are installed inside the first storage room 21, in the cool air generator 50 of FIG. 2, FIG. 5 is an exploded perspective view showing the evaporator, the evaporator cover, the blow fan unit, and the defrost water collecting member of FIG. 4, when seen from behind, FIG. 6 is an exploded perspective view showing a coupling relationship between the blow fan unit and the defrost water collecting member of FIG. 4, and FIG. 7 is a block diagram for describing a cooling cycle of the cool air generator 50, according to an embodiment of the present disclosure.

Referring to FIGS. 2 to 7, the cool air generator 50 may include a compressor 57, a condenser 58, expansion valves 59 and 69, and evaporators 51 and 61. More specifically, in the cool air generator 50, a cooling cycle including the compressor 57, the condenser 58, a flow control valve 56, a first expansion valve 59, a first evaporator 51, a second expansion valve 69, and a second evaporator 61 may be provided. Refrigerant may circulate along the compressor 57, the condenser 58, the expansion valves 59 and 69, and the evaporators 51 and 61 to be compressed, condensed, expanded, and evaporated, which causes heat exchange to generate cool air in the storage room 20.

According to an embodiment of the present disclosure, the first expansion valve 59 and the first evaporator 51 may be installed in the first storage room 21, and the second expansion valve 69 and the second evaporator 61 may be installed in the second storage room 23. As such, separate expansion valves and separate evaporators may be respectively disposed in the first storage room 21 and the second storage room 23 to generate cool air independently in the first and second storage rooms 21 and 23.

The refrigerant may be compressed at high temperature and high pressure by the compressor 57, and then move to the condenser 58. The high-temperature, high-pressure refrigerant may be condensed to a liquid state by the condenser 58. The refrigerant in the liquid state may move from the flow control valve 56 to the first evaporator 51 or the second evaporator 61. As shown in FIG. 7, the first evaporator 51 may be connected in parallel to the second evaporator 61. The pressure and temperature of the condensed refrigerant in the liquid state may be lowered by the expansion valve 59 or 69. Each of the expansion valves 59 and 69 may be a capillary tube. The low-temperature, low-pressure refrigerant passed through the expansion valve 59 or 69 may take away heat from surrounding air to be evaporated so as to exchange heat with the surrounding air. Thereby, air around the evaporator 51 or 61 may be cooled to generate cool air. The completely evaporated refrigerant may be again supplied to the compressor 57 so that a cooling cycle is circulated. The cooling cycle may be circulated to continuously generate cool air in the storage rooms 21 and 23.

FIG. 8 is a block diagram for describing a cooling cycle of the cool air generator 50', according to another embodiment of the present disclosure.

As shown in FIG. 8, in the cool air generator 50', the first evaporator 51' may be connected in series to the second evaporator 61'. The compressor 57', the condenser 58', the first expansion valve 59', the first evaporator 51, the 10 second expansion valve 69', and the second evaporator 61' may be connected in this order. Also, a flow diverter valve 56' may be provided between the condenser 58' and the first evaporator 51'. The flow diverter valve 56' may divert a flow path so that refrigerant condensed by the condenser 58' moves to the first evaporator 51' through the first expansion valve 59' or to the second evaporator 61' through the second expansion valve 69'.

Referring again to FIGS. 2 to 7, the compressor 57 and the condenser 58 may be installed in the machine room 40. The compressor 57 and the condenser 58 may be connected to move refrigerant to the first evaporator 51 and the second evaporator 61.

The first evaporator 51 and the second evaporator 61 respectively installed in the first storage room 21 and the second storage room 23 may have different configurations. The first and second evaporators 51 and 61 will be described in detail, later.

The cool air generator 50 may further include a first evaporator cover 52. The first evaporator cover 52 may be installed in the first storage room 21, together with the first evaporator 51.

The first evaporator 51 may be disposed in the back part of the first storage room 21. The first evaporator 51 may be spaced forward from the back surface of the first storage room 21. More specifically, the first evaporator 51 may be spaced a first distance d1 from the back surface of the first storage room 21, as shown in FIG. 3. The first distance d1 may range from 3 mm to 11.5 mm. More preferably, the first distance d1 may range from 7.65 mm to 9.4 mm in consideration of movement of the first evaporator 51. The first evaporator 51 may be a plate evaporator of roll bond type, as shown in FIGS. 5 and 6.

The first evaporator 51 may be screw-coupled with the back surface of the first storage room 21 to be fixedly installed in the first storage room 21. The first evaporator 51 may be screw-coupled with the back surface of the first storage room 71 by a plurality of screws 51*b* arranged at regular intervals. For example, the first evaporator 51 may be coupled with and fixed on the back surface of the first storage room 21 in the state that the plurality of screws 51*b* are respectively inserted into a plurality of grommets 51*a*. The grommets 51*a* may act to prevent noise from be generated between the screws 51*b* and the first evaporator 51 due to movement of the first evaporator 51. The grommets 51*a* may be made of an elastic material. The number of the grommets 51*a* may be equal to the number of the screws 51*b* for screw-coupling.

The first evaporator 51 may further include a buffer member 51*c*. The buffer member 51*c* may be coupled with the first evaporator 51 and the first evaporator cover 52 so as to reduce noise due to movement of the first evaporator 51. The buffer member 51*c* may be made of an elastic material.

The first evaporator cover 52 may be spaced forward from the first evaporator 51. The first evaporator 52 may be spaced a second distance d2 from the first evaporator 51, as shown in FIG. 3. The second distance d2 may range from 3 mm to 11.5 mm. More preferably, the second distance d2 may range from 7.65 mm to 9.4 mm in consideration of movement of the first evaporator 51.

In the rear part of the first evaporator cover 52, a spacing part 52*g* extending backward may be formed, as shown in FIG. 5. The spacing part 52*g* may be provided to maintain the first evaporator cover 52 spaced a predetermined distance forward from the rear surface of the first storage room 21 and the first evaporator 51. Also, a plurality of coupling members 52*h* may be formed on the spacing part 52*g*. The coupling members 52*h* may enable the spacing part 52*g* to be coupled with the back surface of the first storage room 21.

The first evaporator cover 52 may partition the first storage room 21 into a cool air generating area 21*a* and a storage area 21*b* (see FIG. 2). The cool air generating area 21*a* may correspond to space formed behind the evaporator cover 52 in the storage room 20. In the cool air generating area 21*a*, the evaporator 51 may be disposed, and heat exchange may occur by the evaporator 51 to generate cool air.

The storage area 21*b* may correspond to space formed in front of the evaporator cover 52 in the storage room 20. In the storage area 21*b*, the shelves 25 and the storage container 27 may be arranged. Cool air generated in the cool air generating area 21*a* may move to the storage area 21*b* to adjust the internal temperature of the storage area 21*b*.

As shown in FIG. 4, the lower part of the first evaporator cover 52 may be bent forward. The first evaporator cover 52 may include a first plate 52*a*, a second plate 52*b*, and a third plate 52*c*.

The first plate 52*a* may extend vertically, and be in the shape of a flat plate. The first plate 52*a* may be attached on the storage room 20 in parallel to the back surface of the storage room 20.

The second plate 52*b* may be bent forward and extend from the lower end of the first plate 52*b*. The second plate 52*b* may connect the first plate 52*a* to the third plate 52*c*. The second plate 52*b* may be configured to locate the third plate 52 more forward than the first plate 52*a*.

The third plate 52*c* may extend downward from the lower end of the second plate 52*b*. The third plate 52*c* may be parallel to the first plate 52*a*. The third plate 52*c* may be connected to the second plate 52*b* bent forward and extending, and located more forward than the first plate 52*a*. The second plate 52*b* and the third plate 52*c* may provide space in which a blow fan unit 55 which will be described later can be installed, in the cool air generating area 21*a*.

The first evaporator cover 52 may include a first outlet part 52*d*. The first outlet part 52*d* may be formed in the upper part of the first evaporator cover 52. The first outlet part 52*d* may be located to correspond to the upper part of the first evaporator 51. The first outlet part 52*d* may function as a passage through which air including cool air in the first storage room 21 passes into or out of the inside of the first evaporator cover 52. The first outlet part 52*d* may function as a passage connecting the cool air generating area 21*a* to the storage area 21*b*. The first outlet part 52*d* may be in the shape of at least one slit hole formed in the upper part of the first evaporator cover 52. The first outlet part 52*d* may include one or more slit holes extending horizontally at the same height in the upper part of the first evaporator cover 52.

The first evaporator cover 52 may include a second outlet part 52*e*. The second outlet part 52*e* may be formed in the center area of the first plate 52*a*. The second outlet part 52*e* may be formed below the first outlet part 52*d*. The second outlet part 52*e* may also be in the shape of at least one slit hole. There may be formed a plurality of second outlet parts 52*e* at different heights.

The first evaporator cover 52 may further include an inlet part 52*f*. The inlet part 52*f* may be in the shape of a plurality of slit holes formed in the lower part of the first evaporator cover 52. The inlet part 52*f* may be formed in the third plate 52*c*. The inlet part 52*f* may face the blow fan unit 55 which will be described later.

The first evaporator cover 52 may be coupled with insulation members 52*i* and 52*j* at its both sides. In the insulation members 52*i* and 52*j*, a plurality of holes may be formed to correspond to the first outlet part 52*d* and the second outlet part 52*e* of the first plate 52*a*. The insulation members 52*i* and 52*j* may be coupled with the first evaporator cover 52 to prevent dew formation on the first evaporator cover 52.

As shown in FIGS. 2 and 3, the cool air generator 50 may further include a first flow path 53*a*. The first flow path 53*a* may correspond to space between the first evaporator 51 and the back surface of the storage room 20. The first flow path 53*a* may be spacing from the back surface of the first evaporator 51, and in the first flow path 53*a*, heat exchange with the first evaporator 51 may occur to generate cool air. Also, the first flow path 53*a* may function as a passage through which cool air generated behind the first evaporator 51 moves to the storage area 21*b*.

The first flow path 53*a* may be formed with a first distance d1 that is a distance between the first evaporator 51 and the back surface of the storage room 20. The first distance d1 may range from 3 mm to 11.5 mm. More preferably, the first distance d1 may range from 7.65 mm to 9.4 mm in consideration of movement of the first evaporator 51.

The cool air generator 50 may further include a second flow path 53*b*. The second flow path 53*b* may correspond to space between the first evaporator 51 and the evaporator cover 52. The second flow path 53*b* may be spacing from the first evaporator 51. In the second flow path 53*b*, heat exchange with the first evaporator 51 may occur to generate cool air. Also, the second flow path 53*b* may function as a passage through which cool air generated forward from the first evaporator 51 moves to the storage area 21*b*.

The second flow path 53*b* may be formed with a second distance d2 which is a distance between the first evaporator 51 and the evaporator cover 52. The second distance d2 may range from 3 mm to 11.5 mm. More preferably, the second distance d2 may range from 7.65 mm to 9.4 mm in consideration of movement of the first evaporator 51.

As such, through the first flow path 53*a* and the second flow path 53*b*, both the front and rear parts of the first evaporator 51 may be used to exchange heat and generate cool air. As a result, it is possible to improve the heat exchange efficiency of the first evaporator 51.

As shown in FIGS. 4 to 6, the cool air generator 50 may further include the blow fan unit 55. The blow fan unit 55 may move cool air generated in the cool air generating area

21*a* to the storage area 21*b*. Thereby, the blow fan unit 55 may circulate cool air in the first storage room 21.

For example, the blow fan unit 55 may be disposed below the first evaporator 51. The blow fan unit 55 may be disposed behind the first evaporator cover 52 such that the blow fan unit 55 faces the inlet part 52*f* formed in the first evaporator cover 52.

The blow fan unit 55 may include a first blow fan 55*a*, a blow fan resting member 55*b*, a front fan cover 55*c*, and a rear fan cover 55*d*. The first blow fan 55*a* may be coupled with the blow fan resting member 55*b*, and installed in internal space formed by the front fan cover 55*c* and the rear fan cover 55*d*. The front fan cover 55*c* may include a protrusion part 55*ca* that protrudes forward and forms space in which the first blow fan 55*a* is installed, and an inlet hole 55*cb* facing the first blow fan 55*a* and functioning as a passage through which air in the storage area 21*b* enters the inside of the blow fan unit 55.

The first blow fan 55*a* may be a centrifugal fan. The first blow fan 55*a* may be located to face the inlet hole 55*cb* and the inlet part 2*f* so that air in the storage area 21*b* flows to the center area of the first blow fan 55*a*. Accordingly, the first blow fan 55*a* may blow air in the storage area 21*b* so that the air passes though the inlet part 52*f* and the inlet hole 55*cb* and moves to the inside of the blow fan unit 55.

As shown in FIG. 5, the blow fan unit 55 may be coupled with the lower part of the first evaporator cover 52. In the blow fan unit 55, a communication area 55*e* may be formed so that air flows to the space between the first evaporator cover 52 and the back surface of the first storage room 21. The communication area 55*e* may be provided as space formed between the blow fan unit 55 and the first evaporator cover 52.

When the first blow fan 55*a* rotates, air in the storage area 21*b* may flow to the inside of the blow fan unit 55, and then flow to the first flow path 53*a* and the second flow path 53*b* through the communication area 55*e*. The first blow fan 55*a* may rotate to generate a suction force to thereby make air in the storage area 21*b* flow to the inside of the blow fan unit 55. Also, the first blow fan 55*a* may rotate to make the air entered the inside of the low fan unit 55 move along the inside of the blow fan unit 55 to flow to the first flow path 53*a* and the second flow path 53*b* through the communication area 55*e*. The air entered the first flow path 53*a* and the second flow path 53*b* may move upward along the first flow path 53*a* and the second flow path 53*b*, together with cool air generated due to heat exchange with the first evaporator 51. Through the process, air in the cool air generating area 21, the air including cool air, may move to the storage area 21*b* through the first outlet part 52*d* and the second outlet part 52*e*.

The cool air generator 50 may further include a defrost water collecting member 54. The defrost water collecting member 54 may be coupled with the rear, upper part of the blow fan unit 55, as shown in FIG. 6. As shown in FIG. 2, the defrost water collecting member 54 may be disposed below the first evaporator 51 and the first evaporator cover 52.

The defrost water collecting member 54 may include a drain hole 54 and inclined parts 54*b* and 54*c* extending from both sides of the drain hole 54. The inclined parts 54*b* and 54*c* may be inclined down toward the drain hole 54*a* so as to move defrost water to the drain hole 54*a*. Collected defrost water may be drained out of the first storage room 21 through the drain hole 54*a*.

Referring again to FIG. 2, the cool air generator 50 may further include a second evaporator 61, a second evaporator cover 62, and a second blow fan 85. The second evaporator 61, the second evaporator cover 62, and the second blow fan 85 may be installed in the second storage room 23 to supply cool air to the second storage room 23.

The second evaporator 61 may be installed behind the second evaporator cover 62 in the second storage room 23. The second evaporator 61 may be a fin tube type evaporator.

The second evaporator cover 62 may be disposed in front of the second evaporator 61. The second evaporator cover 62 may partition space in which the second evaporator 61 is disposed from space in which food is stored, in the second storage room 23.

A second blow fan 63 may be disposed above the second evaporator 61. The second blow fan 63 may be installed above the second evaporator cover 62. The second blow fan 63 may move cool air generated by the second evaporator 61 to space in which food is stored. The cool air generated by the second evaporator 61 may be circulated in the second storage room 23 by the second blow fan 63.

A defrost water collecting member 64 may be installed below the second evaporator 61. The defrost water collecting member 64 may be disposed below the second evaporator 61 and the second evaporator cover 62 to collect defrost water generated in the evaporator 61 and the second evaporator cover 62.

The cool air generator 50 may further include a defrosting heater 65 below the second evaporator 61. The defrosting heater 65 may remove frost formed on the second evaporator 61 and the second evaporator cover 62.

As described above, the cool air generator 50 according to an embodiment of the present disclosure may provide the first and second evaporators 51 and 61 in the first and second storage rooms 21 and 23, respectively, to generate cool air.

The first storage room 21 may receive cool air from the first flow path 53*a* formed behind the first evaporator 51 and the second flow path 53*b* formed in front of the first evaporator 51. Due to a suction force generated by the blow fan unit 55, air may flow from the storage area 21*b* to the cool air generating area 21*a* through the inlet part 52*f* of the first evaporator cover 52.

Air entered the cool air generating area 21*a* may rise along the first flow path 53*a* and the second flow path 53*b* to exchange heat with the first evaporator 51. Accordingly, cool air generated from the first evaporator 51 may rise along the first flow path 53*a* and the second flow path 53*b*. Air including cool air moved to the upper part of the cool air generating area 21*a* may move to the storage area 21*b* through the first outlet part 52*d*. A part of the cool air moved along the second flow path 53*b* may move to the storage area 21*b* through the second outlet part 52*e*. Through the process, cool air may circulate in the first storage room 21.

Since the first evaporator 51 is a plate evaporator of roll bond type, and the first evaporator 51 entirely exchanges heat in the first flow path 53*a* and the second flow path 53*b*, the heat exchange efficiency of the first evaporator 51 may be improved.

In the second storage room 23, the defrosting heater 65 may be used to remove frost formed on the second evaporator 61 and the second evaporator cover 62. In contrast, in the first storage room 21, the blow fan unit 55 may be used to remove frost formed on the first evaporator 51 and the first evaporator cover 52, without using any defrosting heater.

More specifically, while the compressor 57 is driven, the blow fan unit 55 may operate to circulate cool air generated in the first evaporator 51 in the first storage room 21. Although the compressor 27 is no longer driven, the blow fan unit 55 may continue to operate to circulate air in the cool air generating area 21*a* through the first flow path 53*a* and the second flow path 53*b*. The blow fan unit 55 may operate for a predetermined time period even after driving of the compressor 57 stops, to circulate air in the cool air generating area 21*a* so as to remove frost formed on the first evaporator 51 and the first evaporator cover 52. For example, the blow fan unit 55 may be driven for at least 10 minutes even after driving of the compressor 57 stops. A time period for which the blow fan unit 55 is driven after driving of the compressor 57 stops may be set depending on an environmental condition of the first storage room 21, such as the temperature, size, etc. of the first storage room 21. Through the process, frost formed on the first evaporator 51 and the first evaporator cover 52 may be removed.

FIG. 9 is a cross-sectional view briefly showing a configuration of a refrigerator including a modified example of the cool air generator 50 of FIG. 2.

Referring to FIG. 9, a cool air generator 70 is different from the cool air generator 50 of FIG. 2 in view of the location of a first blow fan 75, and the remaining components of the cool air generator 70 are the same as the corresponding ones of the cool air generator 50 of FIG. 2. Hereinafter, differences between the cool air generator 70 of FIG. 9 and the cool air generator 50 of FIG. 2 will be described, and descriptions about the same components will be omitted.

The first blow fan 75 may be disposed in the upper part of the cool air generating area 21*a*. The first blow fan 75 may be installed above a first evaporator 71. The first blow fan 75 may blow air in the cool air generating area 21*a* above the first evaporator 71 to move the air to the storage area 21*b* through an outlet part 72*a* of the first evaporator cover 72. The first blow fan 75 may move air in the upper part of the cool air generating area 21*a* to the storage area 21*b* so that air in the lower part of the cool air generating area 21*a* moves upward through the first and second flow paths 73*a* and 73*b*. Accordingly, air in the storage area 21*b* may enter the lower part of the cool air generating area 21*a* through an inlet part 72*b*.

As such, in the cool air generator 70, the first blow fan 75 may be installed above the first evaporator 71 so that air including cool air generated in the cool air generating area 21*a* can move to the storage area 21*b*. Also, the cool air generator 70 may be configured such that air can circulate between the cool air generating area 21*a* and the storage area 21*b* in the storage room 21.

The present disclosure discloses a cool air generator according to another embodiment. Hereinafter, a cool air generator according to another embodiment of the present disclosure will be described.

FIG. 10 is a cross-sectional view briefly showing a configuration of a refrigerator including another embodiment of the cool air generator 50 of FIG. 2.

Referring to FIG. 10, a cool air generator 80 may include a first evaporator 81, a first evaporator cover 82, a first flow path 83*a*, a second flow path 83*b*, and a first blow fan 85. The cool air generator 80 is different from the cool air generator 50 of FIG. 2 in view of the configurations of the first evaporator 82 and the first blow fan 85, and the remaining components of the cool air generator 80 are the same as the corresponding ones of the cool air generator 50 of FIG. 2. Hereinafter, differences between the cool air generator 80 of FIG. 10 and the cool air generator 50 of FIG. 2 will be described, and descriptions about the same components will be omitted.

The first evaporator cover 82 may be spaced forward from the first evaporator 81. Both lateral ends of the first evaporator cover 82 may be attached on both lateral surfaces of the first storage room 21. Thereby, the first evaporator cover 82 may be spaced forward from the first evaporator 81 and fixed.

The first evaporator cover 82 may partition the first storage room 21 into the cool air generating area 21*a* and the storage area 21*b*. The cool air generating area 21*a* may correspond to space behind the first evaporator cover 82 in the first storage room 21. In the cool air generating area 21*a*, the first evaporator 81 may be disposed, and heat exchange may occur by the first evaporator 81 to generate cool air.

The storage area 21*b* may correspond to space formed in front of the first evaporator cover 82 in the first storage room 21. Cool air generated in the cool air generating area 21*a* may move to the storage area 21*b* to adjust the internal temperature of the storage area 21*b*.

The first evaporator cover 82 may include an outlet part 82*a* and an inlet part 82*b*. The outlet part 82*a* may be formed in the upper part of the first evaporator cover 82. The outlet part 82*a* may function as a passage through which air including cool air generated in the cool air generating area 21*a* passes, in the first storage room 21. In other words, the outlet part 82*a* may function as a passage connecting the cool air generating area 21*a* to the storage area 21*b*.

The inlet part 82*b* may be formed in the lower part of the first evaporator cover 82. The inlet part 82*b* may function as a passage through which air in the first storage room 21, the air including cool air generated in the cool air generating area 21*a*, passes. In other words, the inlet part 82*b* may function as a passage connecting the cool air generating area 21*a* to the storage area 21*b*.

The first evaporator cover 82 may further include a cool air passing hole 82*d*. There may be provided a plurality of cool air passing holes 82*d*. The cool air passing holes 82*d* may be arranged at regular intervals, as seen from the front part of the first evaporator cover 82. For example, the cool air passing holes 82*d* may be arranged between the plurality of shelves arranged in the storage room 21, and function as passages through which cool air passes.

The first evaporator cover 82 may further include a cool air blocking part 82*e*. The cool air blocking part 82*e* may be disposed in the lower end of the first evaporator cover 82. The cool air blocking part 82*e* may extend perpendicularly toward the first evaporator 81 from the lower end of the first evaporator cover 82. The cool air blocking part 82*e* may block a part of the lower part of the second flow path 83*b* which will be described later.

The cool air generator 80 may further include the first flow path 83*a*. The first flow path 83*a* may be provided as space between the first evaporator 81 and the back surface of the first storage room 21. In the first flow path 83*a* which is space spaced from the first evaporator 81, heat exchange with the first evaporator 81 may occur to generate cool air.

The cool air generator 80 may further include the second flow path 83*b*. The second flow path 83*b* may be provided as space between the first evaporator 81 and the first evaporator cover 82. In the second flow path 83*b* which is space spaced from the first evaporator 81, heat exchange with the first evaporator 81 may occur to generate cool air. As such, through the first flow path 83*a* and the second flow path 83*b*, both the front and rear parts of the first evaporator 81 may be used to exchange heat and generate cool air. As a result, it is possible to improve the heat exchange efficiency of the first evaporator 81.

The first blow fan 85 may be disposed in the upper part of the cool air generating area 21*a*. The first blow fan 85 may be fixed at the upper part of the first evaporator 81. The first blow fan 85 may move air including cool air in the cool air generating area 21*a* to the storage area 21*b*. In order to move the air to the storage area 21*b*, the first blow fan 85 may be configured to blow air toward the first storage room 21.

For example, the outlet part 82*a* may be configured to block a part of cool air moving from the first blow fan 85 toward the first storage room 21. The outlet part 82*a* may partially overlap with the first blow fan 85, as seen from the front of the storage room 21. For example, the lower end 82*c* of the outlet part 82*a* may be at the same height as the center part of the first blow fan 85.

Accordingly, the first evaporator cover 82 may block a part of air blown forward by the first blow fan 85. The outlet part 82*a* may move a part of air blown by the first blow fan 85 to the storage area 21*b*, and the remaining part of the air to the lower part of the second flow path 83*b* along the first evaporator cover 82.

In the cool air generator 80, the first flow path 83*a* and the second flow path 83*b* may correspond to space formed in front of the first evaporator 81 and space formed behind the first evaporator 81, respectively. In the first flow path 83*a* corresponding to space formed in front of the first evaporator 81 and the second flow path 83*b* corresponding to space formed behind the first evaporator 81, heat exchange may occur to generate cool air.

The cool air generated in the first and second flow paths 83*a* and 83*b* may move to the storage area 21*b*. The cool air generated in the first flow path 83*a* may move to the storage area 21*b* through the outlet part 82*a* by the first blow fan 85. Meanwhile, the cool air generated in the second flow path 83*b* may move to the storage area 21*b* through the cool air passing holes 82*d*. Since a part of air blown by the first blow fan 85 in the upper part of the cool air generating area 21*a* moves downward along the second flow path 83*b*, the part of air may move to the storage area 21*b* through the cool air passing holes 82*d*, together with cool air generated in the second flow path 83*b*.

The cool air blocking part 82*e* may block cool air generated in the second flow path 83*b* from moving downward from the second flow path 83*b*. Thereby, the cool air blocking part 82*e* may block cool air generated in the second flow path 83*b* from moving downward from the second flow path 83*b* without circulating in the first storage room 21.

Accordingly, the cool air generator 80 can cause cool air generated in the first flow path 83*a* to indirectly cool the first storage room 21 through the first blow fan 85, and cool air generated in the second flow path 83*b* to directly cool the first storage room 21 through the cool air passing holes 82*d*. In this way, it is possible to improve the cooling efficiency of the cool air generator 80.

FIG. 11 is a cross-sectional view briefly showing a configuration of a refrigerator including a modified example of the cool air generator 80 of FIG. 10.

Referring to FIG. 11, a cool air generator 90 is different from the cool air generator 80 of FIG. 10 in view of the configuration of a first evaporator cover 82, and the remaining components of the cool air generator 90 are the same as the corresponding ones of the cool air generator 80 of FIG. 10. Hereinafter, differences between the cool air generator 90 of FIG. 11 and the cool air generator 80 of FIG. 10 will be described, and descriptions about the same components will be omitted.

According to an embodiment, a first evaporator cover 92 may include an outlet part 92*a*, an inlet part 92*b*, a cool air passing hole 92*d*, a cool air blocking part 92*e*, and a upper cover 92*c*.

The outlet part 92*a* may be formed in the upper part of the first evaporator cover 92. The outlet part 92*a* may function as a passage through which air in the first storage room 21, the air including cool air generated in the cool air generating area 21*a*, passes. In other words, the outlet part 92*a* may functions as a passage connecting the cool air generating area 21*a* to the storage area 21*b*.

The inlet part 92*b* may function as a passage through which air in the first storage room 21, the air including cool air generated in the cool air generating area 21*a*, passes. In other words, the inlet part 92*b* may function as a passage connecting the cool air generating area 21*a* to the storage area 21*b*.

There may be provided a plurality of cool air passing holes 92*d*. The cool air passing holes 92*d* may be arranged at regular intervals, as seen from the front of the first evaporator cover 92. For example, the cool air passing holes 92*d* may be arranged between the plurality of shelves 25 arranged in the storage room 21, and function as passages through which cool air passes.

The cool air blocking part 92*e* may be disposed in the lower end of the first evaporator cover 92. The cool air blocking part 92*e* may extend perpendicularly toward the first evaporator 91 from the lower end of the first evaporator cover 92. The cool air blocking part 92*e* may block a part of the lower part of a second flow path 93*b* which will be described later.

The upper cover 92*c* may extend perpendicularly toward an evaporator 91 from the upper end of the first evaporator cover 92. The upper cover 92*c* may block the upper part of the second flow path 93*b*. Thereby, the upper cover 92*c* may block air brown from the first blow fan 95 from entering the second flow path 93*b*.

Accordingly, cool air generated in the first flow path 93*a* may indirectly move to the storage area 21*b* through the first blow fan 95, and cool air generated in the second flow path 93*b* may move to the storage area 21*b* through the cool air passing holes 92*d*. More specifically, the cool air generated in the second flow path 93*b* may directly move to the storage area 21*b* only through the cool air passing holes 92*d* due to the cool air blocking part 92*e* and the upper cover 92*c*. As such, since the cool air generator 90 can have advantages of the direct cooling type evaporator and the indirect cooling type evaporator, it is possible to improve the efficiency of the cool air generator 90.

The refrigerator 1 including the cool air generator 50 according to an embodiment of the present disclosure, as described above, is a Bottom Mounted Freezer (BMF) type refrigerator in which the first storage room 21 provided as a refrigerating compartment is located above the second storage room 23 provided as a freezing compartment. However, the cool air generator 50 may be applied to a Top Mounted Freezer (TMF) type refrigerator, a Side by Side (SBS) type refrigerator, and a French Door Refrigerator (FDR) type refrigerator.

Hereinafter, embodiments in which the cool air generator 50 is applied to a TMF type refrigerator, a SBS type refrigerator, and a FDR type refrigerator will be described.

FIGS. 12 to 14 briefly show configurations of refrigerators which are different from the refrigerator 1 of FIG. 2 and to which a cool air generator according to an embodiment of the present disclosure is applied.

Referring to FIG. 12, a refrigerator 110 including a cool air generator 120 may be a TMF type refrigerator. The TMF type refrigerator 110 may include a first storage room 111 provided at its upper part, and a second storage room 113 provided below the first storage room 111. The first storage room 111 may be provided as a freezing compartment, and the second storage room 113 may be provided as a refrigerating compartment.

The refrigerator 110 of FIG. 12 is different from the refrigerator 1 of FIG. 2 in view of the installation locations of individual components of a cool air generator 120. More specifically, in the cool air generator 120, a first evaporator 121, a first evaporator cover 122, a first flow path 123*a*, a second flow path 123*b*, and a first blow fan 125 may be installed in the second storage room 113 provided as a refrigerating compartment, and a second evaporator 127, a second evaporator cover 128, and a second blow fan 129 may be installed in the first storage room 111.

Although the individual components of the cool air generator 120 are installed in different storage rooms compared to the cool air generator 50 of FIG. 2, the cool air generator 120 may have the same configuration as the cool air generator 50 of FIG. 2. Accordingly, descriptions about the same components as those of the cool air generator 50 of FIG. 2 will be omitted.

Referring to FIG. 13, a refrigerator 130 including a cool air generator 140 may be a SBS type refrigerator. The SBS type refrigerator 130 may include a first storage room 131 and a second storage room (not shown), wherein the first storage room 131 and the second storage room may be disposed from side to side. Also, the first storage room 131 may be provided as a refrigerating compartment, and the second storage room may be provided as a freezing compartment.

The cool air generator 140 may have the same configuration as the cool air generator 50 of FIG. 2, although the individual components of the cool air generator 140 are installed in different storage rooms compared to the cool air generator 50 of FIG. 2. Accordingly, descriptions about the same components as those of the cool air generator 50 of FIG. 2 will be omitted.

The cool air generator 140 may include a first evaporator 121, a first evaporator cover 122, a first flow path 123*a*, a second flow path 123*b*, a first blow fan 125, a second evaporator (not shown), a second evaporator cover (not shown), and a second blow fan (not shown). In the first storage room 131, the first evaporator 121, the first evaporator cover 122, the first flow path 123*a*, the second flow path 123*b*, and the first blow fan 125 may be installed. Although not shown in FIG. 13, in the second storage room, the second evaporator, the second evaporator cover, and the second blow fan may be installed.

Referring to FIG. 14, a refrigerator 150 including a cool air generator 160 may be a FDR type refrigerator. The FDR type refrigerator 160 may include a first storage room 151 provided at its upper part, and a second storage room 153 provided below the first storage room 151, wherein the first storage room 151 may be provided as a refrigerating compartment, and the second storage room 153 may be provided as a freezing compartment. The first storage room 151 may be opened/closed by rotating a side-by-side door 152, and the second storage room 153 may be opened/closed by sliding a sliding door 154 forward/backward.

The cool air generator 160 may have the same configuration as the cool air generator 50 of FIG. 2, although the individual components of the cool air generator 160 are installed in different storage rooms compared to the cool air generator 50 of FIG. 2. Accordingly, descriptions about the same components as those of the cool air generator 50 of FIG. 2 will be omitted.

The cool air generator 160 may include a first evaporator 161, a first evaporator cover 162, a first flow path 163*a*, a second flow path 163*b*, a first blow fan 165, a second evaporator 167, a second evaporator cover 168, and a second blow fan 169. In the first storage room 131, the first evaporator 161, the first evaporator cover 162, the first flow path 163*a*, the second flow path 163*b*, and the first blow fan 165 may be installed. In the second storage room 153, the second evaporator 167, the second evaporator cover 168, and the second blow fan 169 may be installed.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

The invention claimed is:

1. A refrigerator comprising:

a main body;

a storage room formed in the main body, wherein a front part of the storage room is open;

a door configured to open or close the front part of the storage room;

an evaporator installed in a back part of the storage room;

an evaporator cover configured to partition the storage room into a storage area and a cool air generating area in which the evaporator is disposed, the evaporator cover being formed between insulation members and the evaporator cover and the insulation members each having a plurality of holes disposed to face the evaporator;

a first flow path formed in the cool air generating area between the evaporator and a back surface of the storage room; and a second flow path formed in the cool air generating area between the evaporator and the evaporator cover where cool air in the second flow path is introduced to the storage area through each of the plurality of holes of the evaporator cover and the insulation members.

2. The refrigerator according to claim 1, further comprising a fan configured to blow cool air generated from the evaporator and to circulate the cool air in the storage room.

3. The refrigerator according to claim 2, wherein the evaporator cover comprises an inlet part formed in a lower part of the evaporator cover, and configured to make the cool air flow into the cool air generating area.

4. The refrigerator according to claim 3, wherein the fan faces the inlet part in the cool air generating area.

5. The refrigerator according to claim 3, wherein the inlet part is formed at a location that is lower than a lower end of the evaporator, in the evaporator cover.

6. The refrigerator according to claim 3, wherein the fan is installed below the evaporator to blow the cool air upward through the first flow path and the second flow path in the cool air generating area.

7. The refrigerator according to claim 3, wherein the evaporator cover further comprises a first outlet part formed in an upper part of the evaporator cover, and configured to move the cool air to the storage area.

8. The refrigerator according to claim 7, wherein the first outlet part is formed at a location that is higher than an upper end of the evaporator, in the evaporator cover.

9. The refrigerator according to claim 7, wherein a part of a lower part of the evaporator cover is bent forward to form space in which the fan is installed in the cool air generating area.

10. The refrigerator according to claim 7, wherein the evaporator cover further comprises a second outlet part formed between the first outlet part and the inlet part.

11. The refrigerator according to claim 2, wherein the fan faces a first outlet part formed in an upper part of the evaporator cover, in the cool air generating area.

12. A refrigerator comprising:

a main body;

a storage room formed in the main body, wherein a front part of the storage room is open;

a door configured to open or close the front part of the storage room;

an evaporator spaced forward from a back surface of the storage room;

an evaporator cover spaced forward from the evaporator and configured to partition the storage room into a storage area and a cool air generating area in which the evaporator is installed, the evaporator cover being formed between insulation members and the evaporator cover and the insulation members each having a plurality of holes disposed to face the evaporator; and a fan configured to blow cool air generated from both a front part and a rear part of the evaporator, and to move the cool air upward where the cool air in the front part is introduced to the storage area through each of the plurality of holes of the evaporator cover and the insulation members.

13. The refrigerator according to claim 12, wherein the evaporator cover comprises an inlet part formed in a lower part of the evaporator cover, and an outlet part formed in an upper part of the evaporator cover.

14. The refrigerator according to claim 13, wherein the fan faces the inlet part in the cool air generating area.

15. The refrigerator according to claim 13, wherein the inlet part is formed at a location that is lower than a lower end of the evaporator, in the evaporator cover.

16. The refrigerator according to claim 13, wherein the outlet part comprises a first outlet part formed at a location that is higher than an upper end of the evaporator.

17. The refrigerator according to claim 16, wherein the outlet part further comprises a second outlet part formed between the first outlet part and the inlet part.

18. A refrigerator comprising:

a main body;

a storage room formed in the main body, wherein a front part of the storage room is open;

a door configured to open or close the opened front part of the storage room;

an evaporator spaced forward from a back surface of the storage room;

an evaporator cover spaced forward from the evaporator and configured to partition the storage room into a storage area and a cool air generating area, the evaporator cover being formed between insulation members and the evaporator cover and the insulation members each having a plurality of holes disposed to face the evaporator;

a flow path through which cool air generated from a front part and a rear part of the evaporator passes where the cool air in the front part is introduced to the storage area through each of the plurality of holes of the evaporator cover and the insulation members; and a fan configured to blow the cool air and to move the cool air upward through the flow path.

19. The refrigerator according to claim 18, wherein the flow path comprises:

a first flow path formed between the evaporator and a back surface of the storage room; and a second flow path formed between the evaporator and the evaporator cover.

20. The refrigerator according to claim 18, wherein the evaporator cover comprises an inlet part formed below the evaporator, and wherein the fan faces the inlet part behind the evaporator cover.

* * * * *